US008394333B2

(12) United States Patent
Sakane et al.

(10) Patent No.: US 8,394,333 B2
(45) Date of Patent: Mar. 12, 2013

(54) HOLDING MATERIAL FOR CATALYTIC CONVERTER, METHOD FOR PRODUCING THE SAME, AND CATALYTIC CONVERTER

(75) Inventors: Tadashi Sakane, Tokyo (JP); Nobuya Tomosue, Tokyo (JP); Kazutoshi Isomura, Tokyo (JP)

(73) Assignee: Nichias Corporation, Tokyo (JP)

( * ) Notice: Subject to any disclaimer, the term of this patent is extended or adjusted under 35 U.S.C. 154(b) by 331 days.

(21) Appl. No.: 12/634,108

(22) Filed: Dec. 9, 2009

(65) Prior Publication Data

US 2010/0143212 A1 Jun. 10, 2010

(30) Foreign Application Priority Data

Dec. 10, 2008 (JP) ..... P.2008-314579

(51) Int. Cl.
*B01D 50/00* (2006.01)

(52) U.S. Cl. ..... 422/179

(58) Field of Classification Search ..... 422/179, 422/177, 180; 428/116
See application file for complete search history.

(56) References Cited

U.S. PATENT DOCUMENTS 4,698,213 A * 10/1987 Shimozi et al. ..... 422/179
2003/0180198 A1 9/2003 Bruck et al.

FOREIGN PATENT DOCUMENTS

| | | | |
|---|---|---|---|
| DE | 102 11 424 | A1 | 9/2003 |
| EP | 1 182 333 | A1 | 2/2002 |
| EP | 1403478 | A2 * | 3/2004 |
| EP | 1895119 | A1 * | 3/2008 |
| GB | 2 394 679 | A | 5/2004 |
| JP | 59-39719 | | 3/1984 |
| JP | 60-66818 | | 5/1985 |
| JP | 10-196355 | | 7/1998 |
| JP | 2004-124719 | | 4/2004 |
| JP | 2005-197904 | | 7/2005 |
| JP | 2005-282374 | | 10/2005 |
| WO | WO 97/02414 | | 1/1997 |

OTHER PUBLICATIONS

Official Action in GB0921580.7 dated Mar. 24, 2010.
Office Action dated Aug. 7, 2012 issued in Japanese Patent Application No. 2008-314579 with English translation, 12 pp.
Office Action in GB 0921580.7 dated May 18, 2012.

* cited by examiner

*Primary Examiner* — Tom Duong
(74) *Attorney, Agent, or Firm* — Nixon & Vanderhye P.C.

(57) ABSTRACT

A holding material for a catalytic converter including a catalyst carrier having an elliptical cross section, a metal casing for receiving the catalyst carrier, and the holding material mounted on the catalyst carrier and interposed in a gap between the catalyst carrier and the metal casing, in which the holding material has a first portion and a second portion, and the first portion in contact with a region of the catalyst carrier, corresponding to 40 to 95% of a major axis centering on an intersection of an ellipse and a minor axis in the elliptical cross section of the catalyst carrier, is larger than the second portion in contact with any other region of the catalyst carrier in basis weight.

15 Claims, 8 Drawing Sheets

HOLDING MATERIAL FOR CATALYTIC CONVERTER, METHOD FOR PRODUCING THE SAME, AND CATALYTIC CONVERTER

FIELD OF THE INVENTION

The present invention relates to a holding material for a catalytic converter for holding in a metal casing a catalyst carrier used in a catalytic converter for removing particulates, carbon monoxide, hydrocarbons, nitrogen oxides and the like contained in exhaust gas discharged from an internal combustion engine such as a gasoline engine or a diesel engine, and a production method thereof. Further, the invention relates to a catalytic converter comprising a catalyst carrier having mounted thereon a holding material for a catalytic converter and incorporated in a casing.

BACKGROUND OF THE INVENTION

A holding material for a catalytic converter (hereinafter also referred to as a "holding material") is obtained by wet molding an aqueous slurry containing inorganic fibers and an organic binder by using a dehydration forming die having a specific shape, followed by hot pressing. Then, the holding material is incorporated in a metal casing in a state where it is mounted on a catalyst carrier (hereinafter also referred to as "canning"). The organic binder contained in the holding material is burnt down by heat applied after canning, and the inorganic fibers restricted by the organic binder in a compressed state expands in a thickness direction, thereby sealing a gap between the catalyst carrier and the casing and holding the catalyst carrier.

On the other hand, with a progress of floor lowering of automobiles, it has been studied to decrease a space necessary for installation of the catalytic converter by changing the cross-sectional shape of the catalyst carrier incorporated under floor from a perfect circle to a flattened shape, that is to say, an ellipse or a track shape. However, heat transfer in the catalyst carrier becomes uneven, or residual stress in a production process of the casing varies with respect to a place of the casing in some cases. Accordingly, after canning, a partial difference in thermal expansion occurs in the casing, resulting in an uneven degree of expansion. As a result, the gap difference between the catalyst carrier and the casing becomes uneven, and sealability or holding force of the holding material is impaired at a place more largely expanded.

As a holding material for this flattened catalyst carrier, there is proposed a holding material in which a portion in contact with an outer circumferential surface in a minor-axis direction of the catalyst carrier is thicker than a portion in contact with an outer circumference in a major-axis direction (see JP-UM-A-59-39719).

SUMMARY OF THE INVENTION

However, the holding material disclosed in JP-UM-A-59-39719 is uneven in thickness, so that it is not applicable to a system called staffing in which the catalyst carrier is pressed into an all-in-one casing, with holding material mounted thereon, although it can comply with a system called clamshell in which the catalyst carrier having the holding material mounted thereon is sandwiched using a casing having a structure separable into two parts.

The invention has been made in view of the above-mentioned problem, and an object of the invention is to provide a holding material for a catalytic converter, which can exhibit conventional sealability and holding force to a flattened catalyst carrier having an elliptical or track-shaped cross section, and further, can employ a stuffing system.

Namely, the present invention relates to the following items (1) to (9).

(1) A holding material for a catalytic converter comprising a catalyst carrier having an elliptical cross section, a metal casing for receiving the catalyst carrier, and the holding material mounted on the catalyst carrier and interposed in a gap between the catalyst carrier and the metal casing, wherein the holding material has a first portion and a second portion, and the first portion in contact with a region of the catalyst carrier, corresponding to 40 to 95% of a major axis centering on an intersection of an ellipse and a minor axis in the elliptical cross section of the catalyst carrier, is larger than the second portion in contact with any other region of the catalyst carrier in basis weight.

(2) A holding material for a catalytic converter comprising a catalyst carrier having a track-shaped cross section, a metal casing for receiving the catalyst carrier, and the holding material mounted on the catalyst carrier and interposed in a gap between the catalyst carrier and the metal casing, wherein the holding material has a first portion and a second portion, and the first portion in contact with a flat portion of the catalyst carrier is larger than the second portion in contact with a curved portion of the catalyst carrier in basis weight.

(3) The holding material for a catalytic converter according to (2), wherein the first portion extends out to a part of the second portions.

(4) The holding material for a catalytic converter according to any one of (1) to (3), wherein the holding material has a constant thickness.

(5) A catalytic converter comprising a catalyst carrier having mounted thereon the holding material for a catalytic converter according to any one of (1) to (4) and incorporated in a metal casing, wherein the first portion of the catalytic converter has a density of 0.15 to 0.7 g/cm$^3$.

(6) A method for producing a holding material for a catalytic converter, the method comprising:

pouring an aqueous slurry containing inorganic fibers into a dehydration forming die having a concave portion formed in a portion corresponding to a first portion of the holding material;

subjecting the aqueous slurry to dehydration molding to obtain a wet molded body; and drying the wet molded body while compressing the whole thereof in a thickness direction thereof.

(7) A method for producing a holding material for a catalytic converter, the method comprising:

pouring an aqueous slurry containing inorganic fibers into a dehydration forming die which is partitioned so that an open area ratio of a portion corresponding to a first portion of the holding material becomes larger than an open area ratio of a portion corresponding to a second portion of the holding material;

subjecting the aqueous slurry to dehydration molding to obtain a wet molded body, and drying the wet molded body while compressing the whole thereof in a thickness direction thereof.

(8) A method for producing a holding material for a catalytic converter, the method comprising:

preparing a first aqueous slurry containing inorganic fibers and a second aqueous slurry containing inorganic fibers in a smaller amount than the first aqueous slurry;

pouring the first aqueous slurry into a portion of a dehydration forming die corresponding to a first portion of the holding material and the second aqueous slurry into a portion of the dehydration forming die corresponding to a second portion of the holding material, the dehydration forming die being provided with partition plates for partitioning the portion corresponding to the first portion from the portion corresponding to the second portion;

subjecting the aqueous slurries to dehydration molding to obtain a wet molded body;

removing the partition plates; and drying the wet molded body while compressing the whole thereof in a thickness direction thereof.

(9) A method for producing a holding material for a catalytic converter, the method comprising:

pouring an aqueous slurry containing inorganic fibers into a portion of a dehydration forming die corresponding to a first portion of the holding material in a larger amount than into a portion the dehydration forming die corresponding to a second portion of the holding material, the dehydration forming die being provided with partition plates for partitioning the portion corresponding to the first portion from the portion corresponding to the second portion;

subjecting the aqueous slurry to dehydration molding to obtain a wet molded body;

removing the partition plates; and drying the wet molded body while compressing the whole thereof in a thickness direction thereof.

The holding material of the invention is for the flattened catalyst carrier having an elliptical or track-shaped cross section. In the elliptical catalyst carrier, a first portion of the holding material in contact with a region of the catalyst carrier, corresponding to 40 to 95% of a major axis centering on an intersection of an ellipse and a minor axis of the catalyst carrier, is higher than a second portion of the holding material in contact with any other region of the catalyst carrier in basis weight. Further, in the track-shaped catalyst carrier, a first portion of the holding material in contact with a flat portion of the catalyst carrier is larger than a second portion of the holding material in contact with a curved portion thereof in basis weight. Accordingly, even when a partial difference in thermal expansion occurs in the casing to make uneven the gap difference between the catalyst carrier and the casing, the amount of inorganic fibers expanded increases in the first portion, and the gap from the casing disappears along the whole circumference of the catalyst carrier. The holding force also becomes uniform. Further, the thickness is constant, so that canning into an all-in-one casing is also possible.

DESCRIPTION OF REFERENCE NUMERALS AND SIGNS

Figure 1:
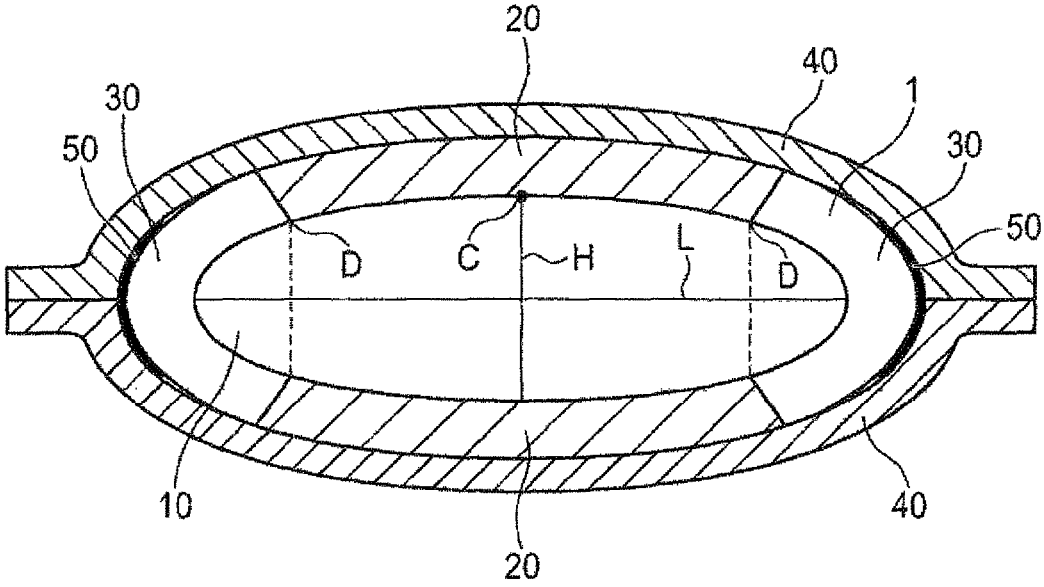
FIG. 1 is a view showing a first embodiment of a holding material for a catalytic converter of the invention, along a cross-sectional shape.

| | |
|---|---|
| 1 and 1A: | Holding Material |
| 10 and 10A | Catalyst Carrier |
| 20 and 20A | First Portion |
| 30 and 30A | Second Portion |
| 100, 110 and 120 | Dehydration Forming Die |
| 100A | Cylindrical Dehydration Forming Die |
| 101 | Slurry Pool |
| 105 | Aqueous Slurry |
| 106 | Suction Pump |
| 150 | Partition Plate |
| 400, 410 and 420 | Wet Molded Body |

DETAILED DESCRIPTION OF THE INVENTION

The invention will be described in detail below.

First Embodiment

The holding material according to a first embodiment is for catalyst carrier having an elliptical cross section. As shown by cross-sectional view in FIG. 1, a holding material 1 is set so that the basis weight of a first portion 20 (between D and D in FIG. 1) in contact with a region corresponding to 40 to 95%, preferably 50 to 90%, more preferably 70 to 90% of a major axis L centering on an intersection C of an ellipse and a minor axis H of the catalyst carrier becomes larger than the basis weight of any other region (hereinafter also referred to as a "second portion") 30.

The basis weight as used herein means the fiber weight per unit area. In the holding material of the invention, the range thereof is not particularly limited as long as the advantages of the invention are exhibited, and is sufficiently from 900 to 4,500 g/m$^2$. More specifically, the range thereof varies depending on the size of a gap between the catalyst carrier and a casing (hereinafter also merely referred to as a "gap"). For example, when the gap is from 2 to 6 mm, the range thereof is sufficiently from 900 to 1,800 g/m$^2$. In the case of 6 to 10 mm, it is sufficiently from 1,800 to 3,600 g/m$^2$, and in the case of 8 to 12 mm, it is sufficiently from 2,200 to 4,500 g/m$^2$.

The basis weight ratio of the first portion 20 and the second portion 30 is not particularly limited as long as the advantages of the invention are exhibited. However, the basis weight of the first portion 20 is sufficiently from 1.05 to 2.0 times the basis weight of the second portion 30, preferably from 1.1 to 1.8 times, and more preferably from 1.1 to 1.6 times. A casing 40 has a similarity shape to that of the catalyst carrier 10, and shows an elliptical cross section. The variation in the gap difference from the catalyst carrier 10 depends on the dimensional accuracy, residual stress, heating temperature and the like of the casing 40. Generally, the gap in the major axis direction of the catalyst carrier is 1.5 times or less the gap in the minor axis direction of the catalyst carrier. For this reason, by adjusting the basis weight of the first portion 20 to 1.05 to 2.0 times the basis weight of the second portion, uniform sealing becomes possible along the whole circumference of the catalyst carrier 10, even when there is such a gap difference.

In view of holding force, thermal insulation performance and sealing performance, it is preferred that the holding material has a constant thickness. Specifically, the thickness is sufficiently from 5 to 30 mm, and preferably from 6 to 12 mm. The fluctuation in thickness is preferably ±15% or less, more preferably ±10% or less, and more preferably ±5% or less.

The easing 40 is separated into two parts up and down in the example shown in the figure. However, it is also possible to perform canning of the holding material 1 by a stuffing system using an all-in-one casing. It is expected to improve productivity of canning by making the thickness of the holding material 1 constant.

Further, when the first portion 20 of the holding material 1 is interposed in the gap between the catalyst carrier 10 and the casing 40, the density thereof is preferably from 0.15 to 0.7 g/cm$^3$, more preferably from 0.2 to 0.6 g/cm$^3$, and particularly preferably from 0.25 to 0.5 g/cm$^3$. The catalyst carrier 10 can be maintained well by adjustment to such a density.

Furthermore, a low-friction sheet 50 having a coefficient of friction of 0.1 to 0.3 may be laminated on an outer circumferential surface of the second portion 30 of the holding material 1, that is to say, on a part or the whole of a surface on the casing side. The lamination with the low-friction sheet 50 decreases frictional resistance on the second portion 30, when the holding material is pressed into the all-in-one casing, thereby being able to smoothly insert the holding material. In addition, when the holding material 1 is mounted on the catalyst carrier 10, there can be avoided a problem that the outer side (casing side) of the holding material 1 is stretched in the second portion 20 having a small curvature radius to cause the occurrence of cracks or creases on an outer surface of the holding material 1. Such cracks or creases on the outer surface of the holding material 1 are unfavorable, because they act as a drag on canning. Further, the low-friction sheet 50 may extend out to a part of an outer circumferential surface of the first portion 20, and furthermore, may be laminated on the whole outer surface of the holding material 1.

Figure 2A:
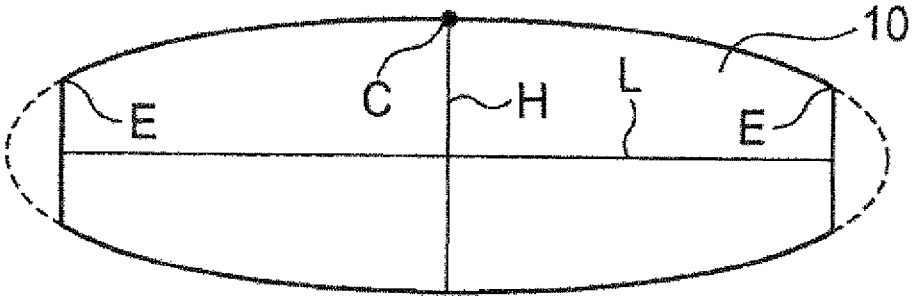
FIGS. 2A and 2B are views showing another example of a first embodiment of a holding material for a catalytic converter of the invention, along a cross-sectional shape.
Figure 2B:
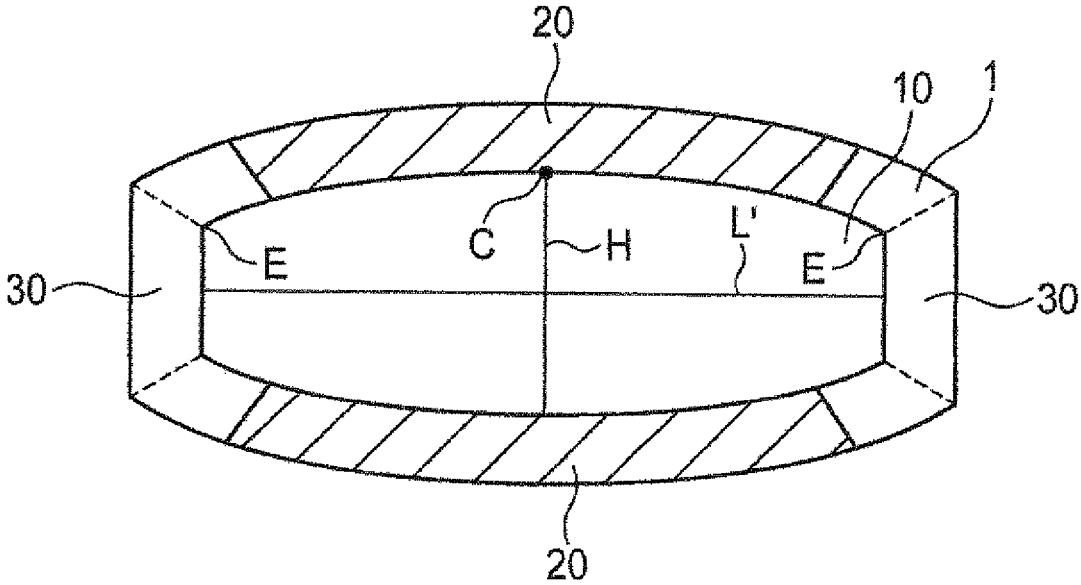

Incidentally, as shown in FIG. 2A, the catalyst carrier 10 may have such a cross-sectional shape that both ends on the major axis side of an ellipse are cut so as to cross with a major axis L at right angles. Although diagrammatic representation is omitted, it may have such a flattened cross-sectional shape that a circle is crushed from the two sides of diameters crossing at right angles or such a cross-sectional shape that respective parts are different in the radius of the curvature. In the invention, these are also included in the catalyst carrier having an elliptical cross section. Also in these cases, the first portion 20 and the second portion 30 of the holding material 1 are formed in a similar range, from the relationship between the minor axis H and the major axis L. Although FIG. 2B shows the holding material 1 for the catalyst carrier shown in FIG. 2A, the first portion 20 may be formed so as to cover the whole circular are length (between E and E) of the catalyst carrier 10 as indicated by dotted lines, as long as the length of a major axis L' is equivalent to or less than 95% of the major axis L of the original ellipse.

Second Embodiment

Figure 3:
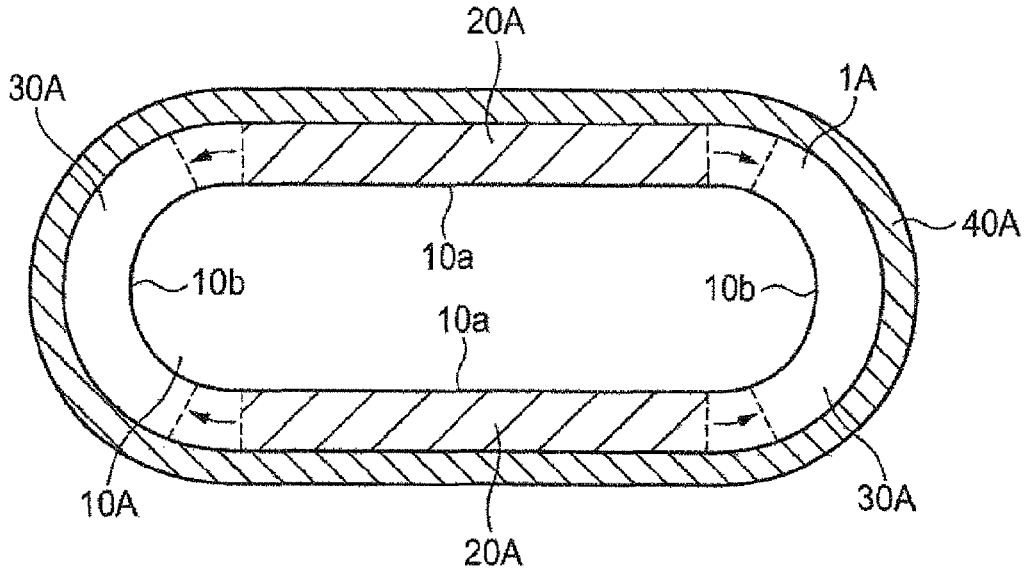
FIG. 3 is a view showing a second embodiment of a holding material for a catalytic converter of the invention, along a cross-sectional shape.

This embodiment applies to a catalyst carrier 10A having a track-shaped cross section, as shown in FIG. 3. That is to say, in a holding material 1A, the basis weight of a first portion 20A in contact with a flat portion 10*a* of the catalyst carrier 10A is set so as to become larger than that of a second portion 30A in contact with a curved portion 10 *b* of the catalyst carrier 10A. Further, as indicated by arrows in the figure, the first portion 20A may extend out so as to occupy a part of the second portion 30A, preferably 5 to 35% of the curved portion 10*b*. The holding force is more improved thereby than in the case where the first portion 20A is formed only in a portion in contact with the flat portion 10*a*.

Further, the thickness of the holding material 1A is in the same range as in the first embodiment, and it is preferably constant. Furthermore, the basis weight ratio of the first portion 20A and the second portion 30A is the same as in the first embodiment, and a low-friction sheet may be laminated on the second portion 30A. Incidentally, the low-friction sheet may extend out to a part of an outer circumferential surface of the first portion 20A, and further, may be laminated on the whole outer surface of the holding material 1A, similarly with the first embodiment.

This catalyst carrier 10A having a track-shaped cross section is mounted in a casing 40A having a similarity shape to the catalyst carrier 10A, with the holding material 1A mounted thereon. Incidentally, the casing 40A is an all-in-one type.

In the above-mentioned respective embodiments, there is no restriction on constituent materials of the holding materials 1 and 1A, as long as they contain inorganic fibers and an organic binder. Further, they may also contain a filler, an inorganic binder or the like which has been conventionally used. Although there is no restriction on the kind thereof, preferred examples thereof will be shown below.

As the inorganic fibers, various inorganic fibers which have hitherto been used in holding materials can be used. For example, alumina fiber, mullite fiber and other ceramic fibers can be appropriately used. More specifically, as the alumina fiber, for example, one containing 90% or more by weight of $Al_2O_3$ (the remainder is $SiO_2$) and having low crystallinity in terms of X-ray crystallography is preferred. Specifically, the crystallinity of the alumina fiber is 30% or less, preferably 15% or less, more preferably, 10% or less. Further, the fiber diameter thereof is preferably from 3 to 8 μm, and the wet volume thereof is preferably 400 cc/5 g or more. As the mullite fiber, for example, one having a mullite composition in which the weight ratio of $Al_2O_3/SiO_2$ is about 70/30 to 80/20 and having low crystallinity in terms of X-ray crystallography is preferred. Specifically, the crystallinity of the mullite fiber is 30% or less, preferably 15% or less, more preferably, 10% or less. Further, the fiber diameter thereof is preferably from 3 to 8 μm and the wet volume thereof is preferably 400 cc/5 g or more. Examples of the other ceramic fibers include silica alumina fiber and silica fiber, and all of them may be ones which have hitherto been used in holding materials. Further, glass fiber, rock wool or biodegradable fiber may be incorporated therein.

The above-mentioned wet volume is calculated by the following method having the following steps:

(1) 5 grams of a dried fiber material is weighed by weigher with accuracy of two or more decimal places;

(2) The weighed fiber material is placed in a 500 g glass beaker;

(3) About 400 cc of distilled water having a temperature of 20 to 25° C. is poured into the glass beaker prepared in the step (2), and stirring is carefully performed by using a stirrer so as not to cut the fiber material, thereby dispersing the fiber material. For this dispersion, an ultrasonic cleaner may be used;

(4) The content of the glass beaker prepared in the step (3) is transferred into a 1,000 ml graduated measuring cylinder, and distilled water is added thereto up to the scale of 1,000 cc;

(5) Stirring of the graduated measuring cylinder prepared in the step (4) is performed by turning the cylinder upside down while blocking an opening of the graduated measuring cylinder with the palm of a hand carefully to prevent water from leaking out. This procedure is repeated 10 times in total;

(6) the sedimentation volume of fiber is measured by visual observation after placing the graduated measuring cylinder quietly under room temperature for 30 minutes after the stop of the stirring; and (7) The above-mentioned operation is performed for 3 samples, and an average value thereof is taken as a measured value.

As the organic binder, conventional organic binders such as a rubber, a water-soluble organic polymer compound, a thermoplastic resin, a thermosetting resin or the like can be used. Specific examples of the rubbers include a copolymer of n-butyl acrylate and acrylonitrile, a copolymer of ethyl acrylate and acrylonitrile, a copolymer of butadiene and acrylonitrile and butadiene rubber. Examples of the water-soluble organic polymer compounds include carboxymethyl cellulose and polyvinyl alcohol. Examples of the thermoplastic resins include a homopolymer and a copolymer of acrylic acid, an acrylic ester, acrylamide, acrylonitrile, methacrylic acid, a methacrylic ester or the like, an acrylonitrile-styrene copolymer and an acrylonitrile-butadiene-styrene copolymer. Examples of the thermosetting resins include a bisphenol type epoxy resin and a novolac type epoxy resin. Incidentally, these organic binders can also be used as a combination of two or more thereof. There is no restriction on the amount of the organic binder used, as long as it is such an amount that the inorganic fibers can be bound, and it is sufficiently from 0.1 to 10 parts by weight based on 100 parts by weight of the inorganic fibers. When the amount of the organic binder is less than 0.1 parts by weight, the binding force is insufficient. In the case of exceeding 10 parts by weight, the amount of the inorganic fibers relatively decreases, resulting in a concern that holding performance and sealing performance necessary as the holding material are not obtained. The amount of the organic binder is preferably from 0.2 to 6 parts by weight, and more preferably from 0.2 to 4 parts by weight.

Further, it is also possible to incorporate organic fibers such as pulp in small amounts as the organic binder. The thinner and longer organic fibers have the higher binding force, so that highly fibrillated cellulose, cellulose nanofiber or the like is preferred. Specifically, the fiber diameter is preferably from 0.01 to 50 μm, and the fiber length is preferably from 1 to 5,000 μm. More preferably, the fiber diameter is from 0.02 to 1 μm, and the fiber length is from 10 to 1,000 μm.

There is no restriction on the amount of such fibrillated fibers used, as long as it is such an amount that the inorganic fibers can be bound, and it is from 0.1 to 5 parts by weight based on 100 parts by weight of the inorganic fibers. When the amount of the fibrillated fibers is less than 0.1 part by weight, the binding force is insufficient. In the case of exceeding 5 parts by weight, the amount of the inorganic fibers relatively decreases to fail to obtain necessary holding performance and sealing performance. The amount of the fibrillated fibers is preferably from 0.1 to 2.5 parts by weight, and more preferably from 0.1 to less than 1 part by weight.

Such fibrillated fibers may be used in combination with an inorganic binder. According to the simultaneous use of the fibrillated fibers and the inorganic binder, even when the amount of the fibrillated fibers used is decreased in order to avoid the above-mentioned problem caused by volatilization of organic components at the time of use, the inorganic fibers can be well bound to be able to provide the holding material for a catalytic converter having a thickness equivalent to that of a conventional holding material. As the inorganic binder, conventional inorganic binder can be used. Examples thereof include glass frit, colloidal silica, alumina sol, silicate soda, titania sol, lithium silicate, a clay mineral such as montmorillonite and water glass. These inorganic binders can also be used as a combination of two or more thereof. There is no restriction on the amount of the inorganic binder used, as long as it is such an amount that the inorganic fibers can be bound, and it is from 0.1 to 10 parts by weight based on 100 parts by weight of the inorganic fibers. When the amount of the inorganic binder is less than 0.1 parts by weight, the binding force is insufficient. In the case of exceeding 5 parts by weight, the amount of the inorganic fibers relatively decreases to fail to obtain necessary holding performance and sealing performance. The amount of the inorganic binder is preferably from 0.2 to 6 parts by weight, and more preferably from 0.2 to 4 parts by weight.

Incidentally, the organic content is preferably from 0.3 to 4.0% by weight, more preferably from 0.5 to 3.0% by weight, and particularly preferably from 1.0 to 2.5% by weight, based on the whole amount of the holding material. It is preferred that the organic content is smaller, because volatile gas decreases when heat is applied after canning. The organic content as used herein can be substituted by the ignition loss rate after heating at 700° C. for 30 minutes.

Figure 4:
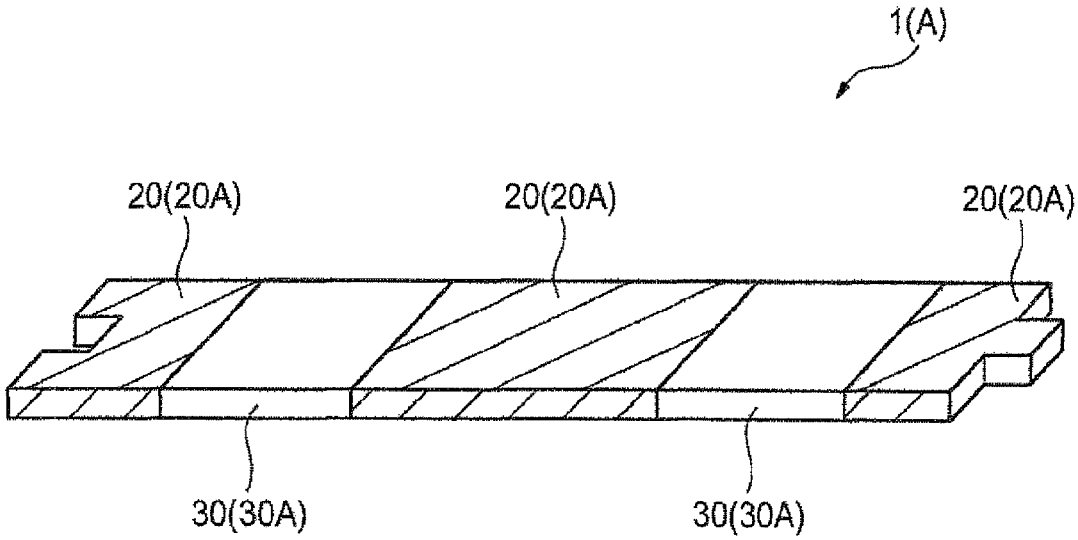
FIG. 4 is a perspective view showing an embodiment in which a holding material for a catalytic converter of the invention is formed in a mat shape.
Figure 5:
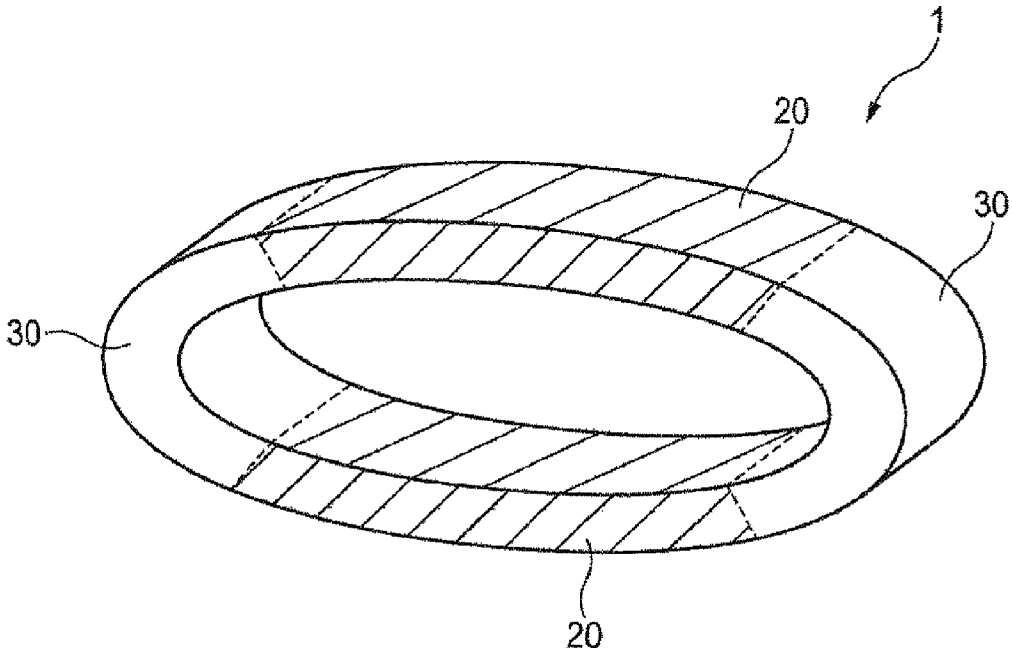
FIG. 5 is a perspective view showing an embodiment (corresponding to FIG. 1) in which a holding material for a catalytic converter of the invention is formed in a cylindrical shape.

The above-mentioned holding materials 1 and 1A have no particular restriction on the shape thereof, and may be a mat-like one (mat type holding material) composed of one sheet or a cylindrical one (cylindrical holding material) having an elliptical or track-shaped cross section. A mat type holding material 1 (1A) is shown in FIG. 4. Both ends are joined to each other to form the first portion 20 (20A) located above in FIG. 1 and FIG. 3, so that first portions 20 (20A) of both ends become a half of a central first portion 20 (20A) in width. Further, in the mat type holding material 1 (1A), a concave portion is formed in a first portion 20 (20A) of one end, and a convex portion is formed in a first portion 20 (20A) of the other end, in this case. The both ends are joined so that the concave portion and the convex portion are brought into engagement with each other. Incidentally, it is also possible to have such a constitution that both ends are joined to each other at a second portion 30 (30A). A concave portion and a convex portion are formed in the second portion 30 (30A). Further, FIG. 5 shows the cylindrical holding material having an elliptical cross section shown in FIG. 1. Incidentally, the mat type holding material requires an operation of winding it around the catalyst carrier 10 (10A), so that the cylindrical holding material is more advantageous in view of labor and cost.

Methods for producing the above-mentioned holding materials will be illustrated below.

First Production Method

Figure 6:
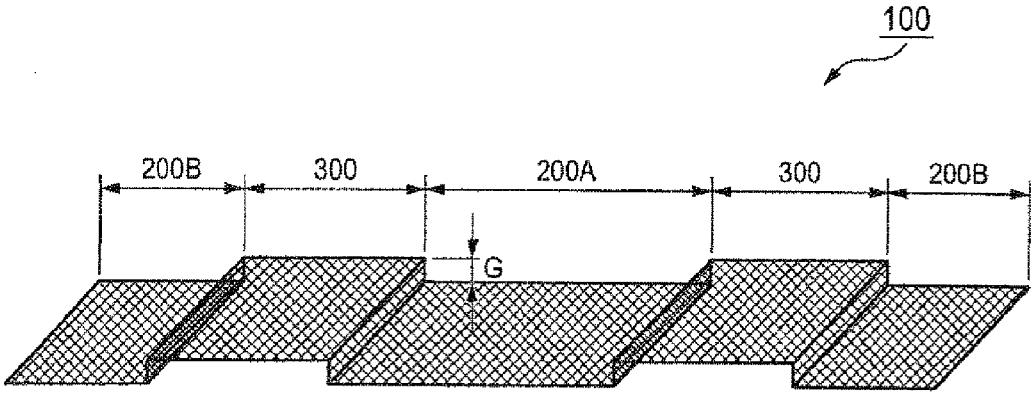
FIG. 6 is a schematic view showing a dehydration forming die used in a first production method of the invention.

First, as shown in FIG. 6, using a dehydration forming die 100 in which a first concave portion 200A is formed in the center, depressed (step: G) with a width corresponding to the first portion 20 (20A) of the holding material 1 (1A), convex portions 300 and 300 are formed on both sides thereof with a width corresponding to the second portions, and second concave portions 200B and 200B having the same depth as the first concave portion 200A are further formed at both ends, an aqueous slurry containing holding material constituent materials is poured therein from above in the figure, and the holding material constituent materials are adhered over the whole surface of the dehydration forming die 100 to a predetermined thickness by dehydration molding. Incidentally, the width of the second concave portions 200B and 200B is a half of the width of the first concave portion 200A. The dehydration forming die 100 is provided with a frame surrounding the convex portions 300 and the concave portions 200A and 200B, but the frame is not shown herein. The same applies to production methods described later.

The dehydration forming die 100 may be any, as long as it is permeable to water in the aqueous slurry, and can leave the constituent materials of the holding material, such as inorganic fibers, on a surface of the die. For example, there can be used a wire mesh, a flat plate having a number of minute holes formed therein, or the like. Description will be made herein, exemplifying the wire mesh.

Figure 7A:
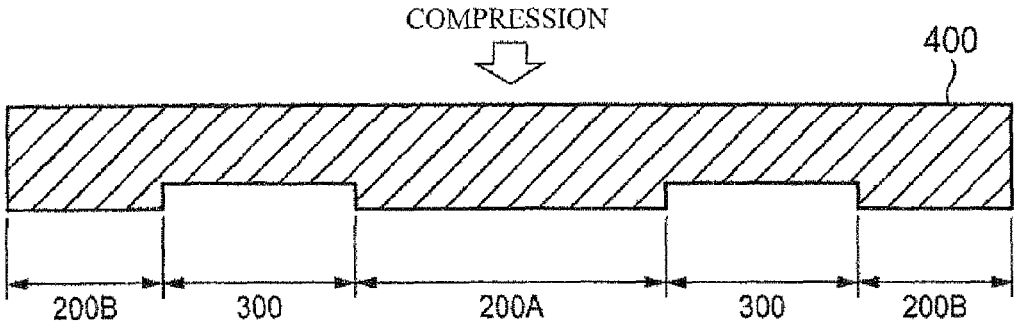
FIG. 7A is a cross-sectional view showing a wet molded body obtained by the first production method.

Subsequently, the dehydration forming die 100 is removed to obtain a wet molded body 400 in which portions corresponding to the concave portions 200A and 200B, that is to say, the first portions of the holding material 1 (1A), are thicker by the step G, as shown in FIG. 7A.

Figure 7B:
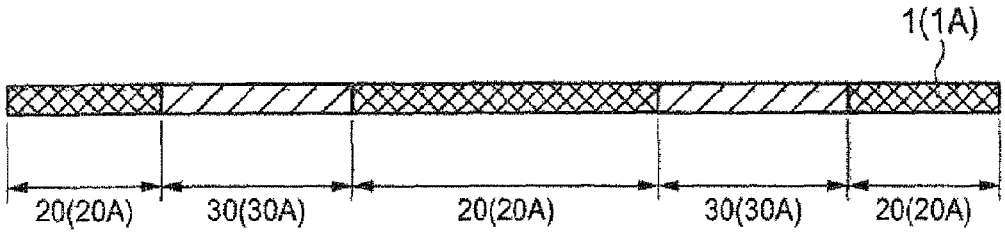
FIG. 7B is a cross-sectional view showing a mat-like holding material obtained after compression and drying.

Then, this wet molded body 400 was pressed from above in the figure to the same thickness, and dried, for example, at 100 to 180° C., thereby obtaining the holding material 1 (1A) in which the basis weight of the first portions 20 (20A) is larger than the basis weight of the second portions 30 (30A), as shown in FIG. 7B. This holding material 1 (1A) is flat and mat-like, and wound around the catalyst carrier so that end faces of the first portions 20 (20A) at both ends are brought into abutting contact with each other.

In the above-mentioned first production method, the difference in basis weight between the first portions and the second portions can be controlled by appropriately changing the size of the step G. That is to say, for example, delicate control such as a difference in basis weight of 1.1 times can be surely performed only by decreasing the size of the step G.

Further, the dehydration forming die 100 shown in the figure corresponds to the mat type holding material composed of one sheet. However, using a long hydration forming die formed by an alternate continuous arrangement of the concave portions 200A and the convex portions 300, an aqueous slurry is similarly poured therein, hydration molded, compressed and dried to prepare a long mat-like holding material, and thereafter, it is cut at portions corresponding to ends of the second concave portions 200B, thereby being able to produce a number of mat type holding materials at once.

Figure 8:
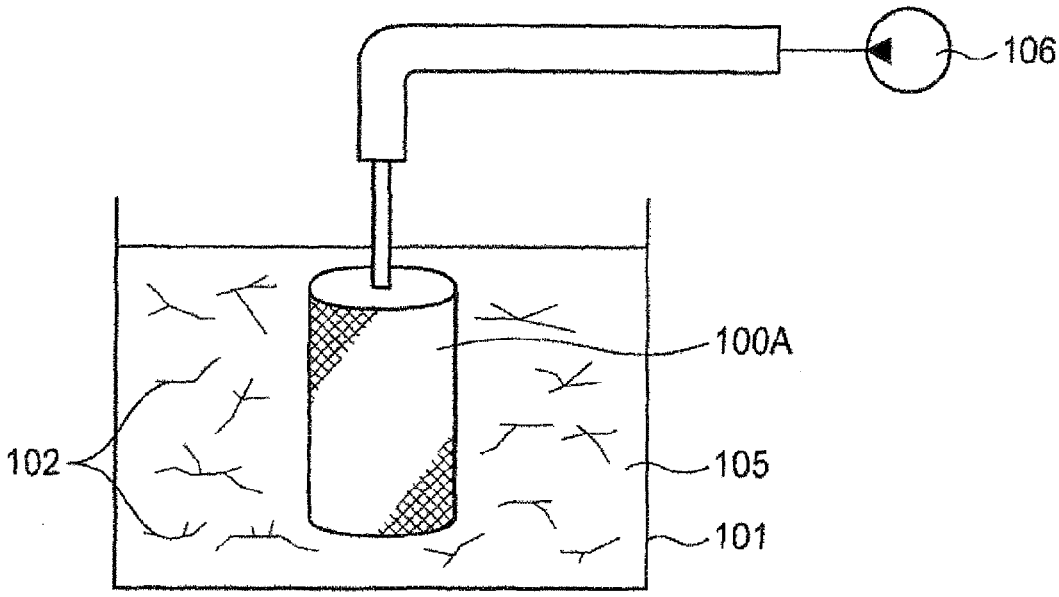
FIG. 8 is a schematic view illustrating a method for producing a cylindrical holding material by a dehydration molding method.
Figure 9:
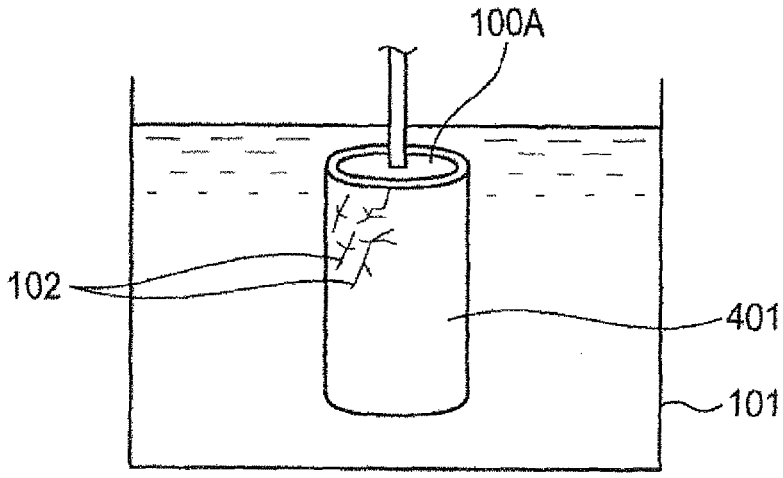
FIG. 9 is a schematic view showing a cylindrical wet molded body obtained by the dehydration molding method shown in FIG. 8.

Furthermore, it is also possible to produce a cylindrical holding material by connecting ends of the second concave portions 200B of the hydration forming die 100 shown in FIG. 6 to each other to form an ellipse or a track shape. That is to say, as shown in FIG. 8, a cylindrical hydration forming die 100A obtained by connecting the ends of the second concave portions 200B of the hydration forming die 100 to each other is immersed in an aqueous slurry 105 stored in a slurry pool 101, and suction is performed with a suction pump 106 from the inside of the cylindrical hydration forming die 100A. As shown in FIG. 9, inorganic fibers 102 are adhered thereby to a surface of the cylindrical hydration forming die 100A to obtain a cylindrical wet molded body 401. This cylindrical wet molded body 401 becomes one in which both ends of the wet molded body 400 shown in FIG. 7 are connected to each other. Then, this cylindrical wet molded body 401 is pressed with a cylindrical pressing member and dried, thereby obtaining the cylindrical holding member as shown in FIG. 5.

Second Production Method

Figure 10:
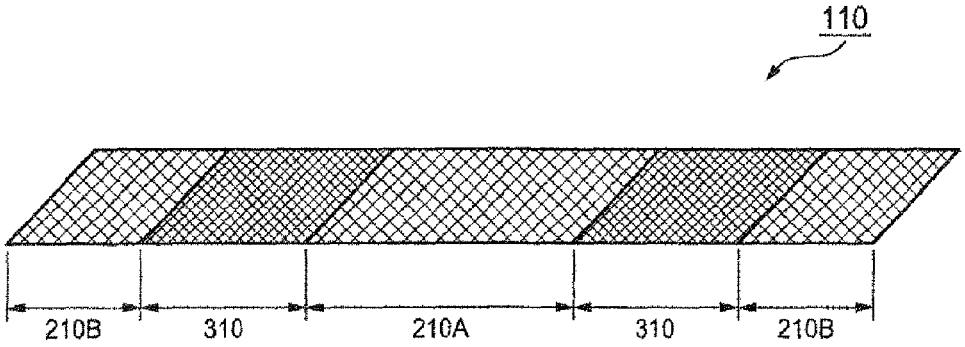
FIG. 10 is a schematic view showing a dehydration forming die used in a second production method of the invention.

As shown in FIG. 10, using a dehydration forming die 110 in which a first region 210A having a predetermined open area ratio (aperture) is formed in the center with a width corresponding to the first portion 20 (20A) of the holding material 1 (1A), second regions 310 and 310 having a smaller open area ratio than the first region 210A are formed on both sides thereof with a width corresponding to the second portions, and third regions 210B and 210B having the same open area ratio as the first region 210A are further formed at both ends, an aqueous slurry containing holding material constituent materials is poured therein from above in the figure, and the holding material constituent materials are adhered over the whole surface of the dehydration forming die 110 to a predetermined thickness by dehydration molding. Incidentally, the width of the regions 210B and 210B is a half of the width of the first region 210A. Further, each open area ratio of the first region 210A and the second regions 210B is set depending on the basis weight ratio of the first portions 20 (20A) and the second portions 30 (30A) of the holding material 1 (1A).

Figure 11A:
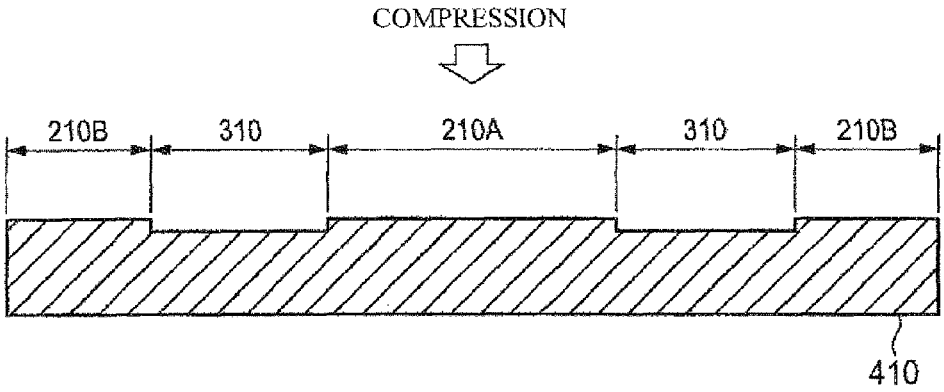
FIG. 11A is a cross-sectional view showing a wet molded body obtained by the second production method.

Here, a large amount of water is sucked in the first region 210A and the third region 210B having a large open area ratio, and the inorganic fibers are sucked together associated therewith. Accordingly, the amount of the fibers adhered increases in the first region 210A and the third region 210B, and these portions become thick also in a resulting wet molded body 410, as shown in FIG. 11A. These portions correspond to the first portions of the holding material 1 (1A).

Figure 11B:
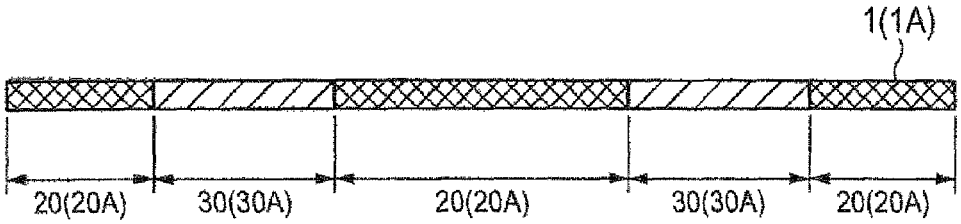
FIG. 11B is a cross-sectional view showing a mat-like holding material obtained after compression and drying.

Then, this wet molded body 410 was pressed to the same thickness, and dried, thereby obtaining a holding material 1 (1A) in which the basis weight of the first portions 20 (20A) is larger than the basis weight of the second portions 30 (30A), as shown in FIG. 11B. This holding material 1 (1A) is flat and mat-like, and wound around the catalyst carrier so that end faces of the first portions 20 (20A) at both ends are brought into abutting contact with each other.

In the above-mentioned second production method, the difference in basis weight between the first portions and the second portions can be controlled by appropriately changing the open area ratio. That is to say, for example, delicate control such as a difference in basis weight of 1.1 times can be surely performed only by slightly decreasing the open area ratio.

Further, the dehydration forming die 110 shown in the figure corresponds to the mat type holding material composed of one sheet. However, using a long hydration forming die formed by an alternate continuous arrangement of the first regions 210A and the second regions 210B, an aqueous slurry is similarly poured therein, hydration molded, compressed and dried to prepare a long mat-like holding material, and thereafter, it is cut at portions corresponding to ends of the second regions 210B, thereby being able to produce a number of mat type holding materials at once.

Furthermore, in order to form the cylindrical holding material having an elliptical or track-shaped cross section, using a cylindrical hydration forming die formed into an elliptical or track shape by connecting the third regions 210B and 210E of the flat hydration forming die 110 shown in FIG. 10 to each other, an aqueous slurry is poured therein, followed by dehydration molding, compression and drying.

Third Production Method

Figure 12:
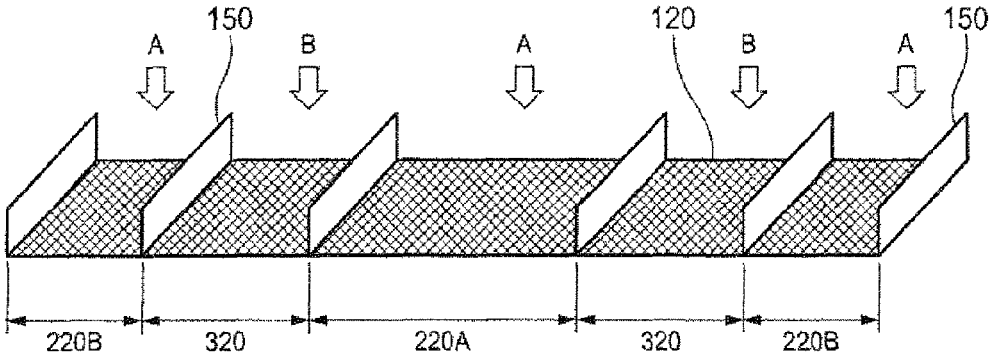
FIG. 12 is a schematic view showing a dehydration forming die used in a third and fourth methods of the invention.

As shown in FIG. 12, using a dehydration forming die 120 in which a first region 220A is partitioned in the center with a width corresponding to the first portion 20 (20A) of the holding material 1 (1A), second regions 320 and 320 are partitioned on both sides thereof with a width corresponding to the second portions, and third regions 220B and 220B are partitioned at both ends, by partition plates, a first aqueous slurry containing holding material constituent materials in a higher concentration is poured in the first region 220A and the third regions 220B, a second aqueous slurry lower in concentration than the first aqueous slurry is poured in the second regions 320, and the holding material constituent materials are adhered over the whole surface of the dehydration forming die 120 to a predetermined thickness by dehydration molding. Incidentally, the width of the third regions 220B and 220B is a half of the width of the first region 220A. Further, each concentration of the first aqueous slurry A and the second aqueous slurry B is set depending on the basis weight ratio of the first portions 20 (20A) and the second portions 30 (30A) of the holding material 1 (1A).

Figure 13A:
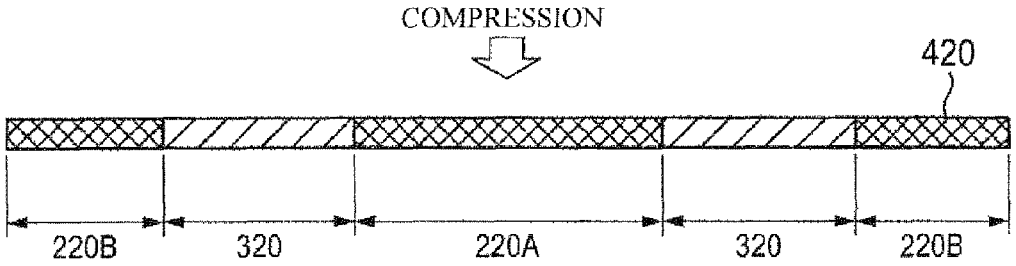
FIG. 13A is a cross-sectional view showing a wet molded body obtained by the third and fourth production methods.

Subsequently, the dehydration forming die 120 is removed to obtain a wet molded body 420 in which the first region 220A and the third regions 220B of the dehydration forming die 120, that is to say, portions corresponding to the first portions of the holding material 1 (1A), have a higher concentration, as shown in FIG. 13A.

Figure 13B:
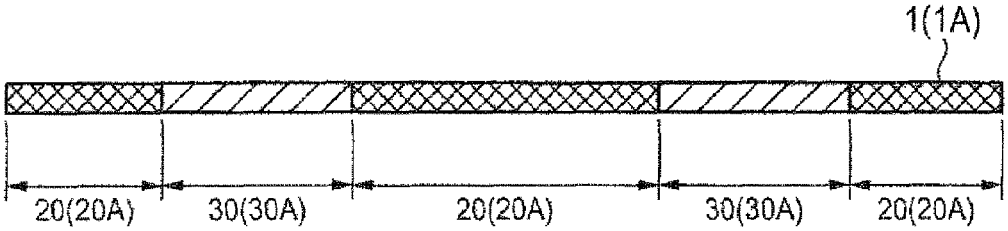
FIG. 13B is a cross-sectional view showing a mat-like holding material obtained after compression and drying.

Then, this wet molded body 420 was pressed to the same thickness, and dried, thereby obtaining a holding material 1 (1A) in which the basis weight of the first portions 20 (20A) is larger than the basis weight of the second portions 30 (30A), as shown in FIG. 13B. This holding material 1 (1A) is flat and mat-like, and wound around the catalyst carrier so that end faces of the first portions 20 (20A) at both ends are brought into abutting contact with each other.

Further, the dehydration forming die 120 shown in the figure corresponds to the mat type holding material composed of one sheet. However, using a long hydration forming die formed by an alternate continuous arrangement of the first regions 220A and the second regions 320, an aqueous slurry is similarly poured therein, hydration molded, compressed and dried to prepare a long mat-like holding material, and thereafter, it is cut at portions corresponding to ends of the third regions 220B, thereby being able to produce a number of mat type holding materials at once.

Furthermore, in order to form the cylindrical holding material having an elliptical or track-shaped cross section, using a cylindrical hydration forming die formed into an elliptical shape by connecting the third regions 220B and 220B of the flat hydration forming die 120 shown in FIG. 12 to each other, an aqueous slurry is poured therein, followed by dehydration molding, compression and drying.

Fourth Production Method

Using the same dehydration forming die 120 partitioned by partition plates 150 as in the third production method, an aqueous slurry having the same content of materials for the holding material is poured in the first region 200A and the third regions 200B in larger amounts than in the second regions 320 and 320. Incidentally, the amount of the slurry poured in the first region 200A and the third regions 200B and the amount of the slurry poured in the second regions 320 and 320 are set depending on the basis weight ratio of the first portions 20 (20A) and the second portions 30 (30A) of the holding material 1 (1A). Operations are hereafter performed in the same manner as in the third production method to obtain a mat-like holding material as shown in FIG. 13B.

EXAMPLES

The invention will be further described with reference to examples and a comparative example, but the invention is not to be construed as being limited thereby. Incidentally, a holding material for an elliptical catalyst carrier having a minor axis of 50 mm and a major axis of 100 mm was prepared in each case.

Example 1

An aqueous slurry was prepared in which 0.5 parts by weight of an acrylic resin as an organic binder, 3 parts by weight of colloidal silica as an inorganic binder and 10,000 parts by weight of water were contained, based on 100 parts by weight of alumina fibers (alumina: 96% by weight, silica: 4% by weight) as inorganic fibers. Then, the aqueous slurry was uniformly poured in a wire mesh (hydration forming die) in which a concave portion having a width of 1,000 mm corresponding to 70 mm as 70% of the major axis and a depth (G) of 10 mm was formed in the center as the first concave portion 200A, convex portions having a width of 67 mm was formed on both sides thereof as the convex portions 300, and concave portions having a width of 50 mm and a depth (G) of 10 mm were further formed on outer sides thereof as the second concave portions 200B, as shown in FIG. 6, and subjected to dehydration molding to obtain a wet molded body. Then, the wet molded body was dried at 100° C. while compressing the whole thereof in a thickness direction to the same thickness to obtain a mat-like holding material in which the first portions having a width of 100 mm and a high basis weight were formed in the center and in two places of both ends, as shown in FIG. 7B. The thickness of the resulting holding material was approximately constant and 6.7 mm on average. The fluctuation in thickness was ±0.5 mm or less. The basis weight of the first portions was 1,100 g/m$^2$, the basis weight of the second portions was 1,000 g/m$^2$, and the basis weight of the first portions was 1.1 times the basis weight of the second portions. The holding material contained 96.6% by weight of the inorganic fibers, 0.5% by weight of the organic binder and 2.9% by weight of the inorganic binder, based on the whole amount of the holding material. The ignition loss rate thereof was measured. As a result, the organic content was 0.5% by weight.

Then, the resulting holding material was wound around a catalyst carrier in such a manner that centers of the first portions agreed with an intersection of an ellipse and a minor axis, as shown in FIG. 1, to obtain a catalyst carrier unit. This catalyst carrier unit was pressed into an elliptical cylindrical SUS casing having an outer minor axis of 61 mm, an outer major axis of 111 mm and a thickness of 1.5 mm (gap: 4.0 mm) to prepare a catalytic converter. After press fitting, no change was observed in the outer major axis, but the outer minor axis was expanded by 0.8 mm. From this, the gap of a major axis portion became 4.4 mm. As a result, the density became 0.25 g/cm$^3$ at all sites of the holding material.

Example 2

An aqueous slurry was prepared in which 0.5 parts by weight of an acrylic resin as an organic binder, 3 parts by weight of colloidal silica as an inorganic binder and 10,000 parts by weight of water were contained, based on 100 parts by weight of alumina fibers (alumina: 80% by weight, silica:

20% by weight) as inorganic fibers. Then, the aqueous slurry was uniformly poured on the whole surface of a wire mesh in which a region having an open area ratio of 75% and corresponding to the first region 210A was formed with a width of 100 mm, regions having an open area ratio of 50% and corresponding to the second regions 310 were formed with a width of 67 mm on both sides thereof, and regions having an open area ratio of 75%, corresponding to the third regions 210B, were further formed with a width of 50 mm on outer sides thereof, as shown in FIG. 10, and subjected to dehydration molding to obtain a wet molded body. Then, the wet molded body was dried at 100° C. while compressing the whole thereof in a thickness direction to the same thickness to obtain a mat-like holding material in which the first portions having a width of 100 mm and a high basis weight were formed in the center and in two places of both ends, as shown in FIG. 11B. The thickness of the resulting holding material was approximately constant and 6.7 mm on average. The fluctuation in thickness was ±0.5 mm or less. The basis weight of the first portions was 1,100 g/m$^2$, the basis weight of the second portions was 1,000 g/m$^2$, and the basis weight of the first portions was 1.1 times the basis weight of the second portions. The holding material contained 96.6% by weight of the inorganic fibers, 0.5% by weight of the organic binder and 2.9% by weight of the inorganic binder, based on the whole amount of the holding material. The ignition loss rate thereof was measured. As a result, the organic content was 0.5% by weight.

Then, the resulting holding material was wound around a catalyst carrier in the same manner as in Example 1 to obtain a catalyst carrier unit. This catalyst carrier unit was pressed into an elliptical cylindrical SUS casing having an outer minor axis of 61 mm, an outer major axis of 111 mm and a thickness of 1.5 mm (gap: 4 mm) to prepare a catalytic converter. After press fitting, no change was observed in the outer major axis, but the outer minor axis was expanded by 0.8 mm. From this, the gap of a major axis portion became 4.4 mm. As a result, the density became 0.25 g/cm$^3$ at all sites of the holding material.

Example 3

A first aqueous slurry A was prepared in which 0.5 parts by weight of an acrylic resin as an organic binder, 3 parts by weight of colloidal silica as an inorganic binder and 10,000 parts by weight of water were contained, based on 100 parts by weight of alumina fibers (alumina: 80% by weight, silica: 20% by weight) as inorganic fibers. Further, a second aqueous slurry B was prepared in which 0.45 parts by weight of an acrylic resin as an organic binder, 2.7 parts by weight of colloidal silica as an inorganic binder and 10,000 parts by weight of water were contained, based on 91 parts by weight of alumina fibers (alumina: 80% by weight, silica: 20% by weight) as inorganic fibers. Then, using a wire net in which the region 220A having a width of 100 mm was partitioned in the center, the regions 320 having a width of 67 mm were partitioned on both sides thereof, and the regions 220B having a width of 50 mm were partitioned at both ends, by partition plates, as shown in FIG. 12, the first aqueous slurry A was poured in the region 220A and the regions 220B, and the second aqueous slurry B was poured in the regions 320, followed by dehydration molding to obtain a wet molded body. Then, the wet molded body was dried at 100° C. while compressing the whole thereof in a thickness direction to the same thickness to obtain a mat-like holding material in which the first portions having a width of 100 mm and a high basis weight were formed in the center and in two places of both ends, as shown in FIG. 13B. The thickness of the resulting holding material was approximately constant and 6.7 mm on average. The fluctuation in thickness was ±0.5 mm or less. The basis weight of the first portions was 1,100 g/m$^2$, the basis weight of the second portions was 1,000 g/m$^2$, and the basis weight of the first portions was 1.1 times the basis weight of the second portions. The holding material contained 96.6% by weight of the inorganic fibers, 0.5% by weight of the organic binder and 2.9% by weight of the inorganic binder, based on the whole amount of the holding material. The ignition loss rate thereof was measured. As a result, the organic content was 0.5% by weight.

Then, the resulting holding material was wound around a catalyst carrier in the same manner as in Example 1 to obtain a catalyst carrier unit. This catalyst carrier unit was pressed into an elliptical cylindrical SUS casing having an outer minor axis of 61 mm, an outer major axis of 111 mm and a thickness of 1.5 mm (gap: 4 mm) to prepare a catalytic converter. After press fitting, no change was observed in the outer major axis, but the outer minor axis was expanded by 0.8 mm. From this, the gap of a major axis portion became 4.4 mm. As a result, the density became 0.25 g/cm$^3$ at all sites of the holding material.

Example 4

An aqueous slurry was prepared in which 0.5 parts by weight of an acrylic resin as an organic binder, 3 parts by weight of colloidal silica as an inorganic binder and 10,000 parts by weight of water were contained, based on 100 parts by weight of alumina fibers (alumina: 80% by weight, silica: 20% by weight) as inorganic fibers. Then, using the same wire net as in Example 3, the aqueous slurry was poured therein so that the amount of the slurry poured in the regions 320 is 9% smaller than that poured in the region 220A and the regions 220B, and hereafter, a holding material was obtained in the same manner as in Example 3. The thickness of the resulting holding material was approximately constant and 6.7 mm on average. The fluctuation in thickness was ±0.5 mm or less. The basis weight of the first portions was 1,100 g/m$^2$, the basis weight of the second portions was 1,000 g/m$^2$, and the basis weight of the first portions was 1.1 times the basis weight of the second portions. The holding material contained 96.6% by weight of the inorganic fibers, 0.5% by weight of the organic binder and 2.9% by weight of the inorganic binder, based on the whole amount of the holding material. The ignition loss rate thereof was measured. As a result, the organic content was 0.5% by weight.

Then, the resulting holding material was wound around a catalyst carrier in the same manner as in Example 1 to obtain a catalyst carrier unit. This catalyst carrier unit was pressed into an elliptical cylindrical SUS casing having an outer minor axis of 61 mm, an outer major axis of 111 mm and a thickness of 1.5 mm (gap: 4 mm) to prepare a catalytic converter. After press fitting, no change was observed in the outer major axis, but the outer minor axis was expanded by 0.8 mm. From this, the gap of a major axis portion became 4.4 mm. As a result, the density became 0.25 g/cm$^3$ at all sites of the holding material.

Comparative Example 1

The same aqueous slurry as in Example 1 was poured in a flat dehydration forming die, followed by dehydration molding, compression and drying to obtain a uniform holding material having a thickness of 6.7 mm and a basis weight of 1,000 g/m$^2$.

Further, the holding material was wound around a catalyst carrier to obtain a catalyst carrier unit. Then, the catalyst carrier unit was pressed into a cylindrical SUS casing having an elliptical cross section and having an outer minor axis of 61 mm, an outer major axis of 111 mm and a thickness of 1.5 mm (gap: 4 mm) to prepare a catalytic converter. After press fitting, no change was observed in the outer major axis, but the outer minor axis was expanded by 0.8 mm. From this, the gap of a major axis portion became 4.4 mm. As a result, the density of a minor axis portion of the holding material became 0.25 g/cm$^3$, and the density of the major axis portion became 0.227 g/cm$^3$.

Evaluation of Holding Force

For the catalytic converters of Examples 1 to 4 and Comparative Example 1, the holding force of the holding materials was evaluated by using a vibration test system. Evaluation conditions were as follows. The results thereof are shown in FIG. 1.

Test temperature: 900° C.

Acceleration: 60 G

TABLE 1

Results of Heating Vibration Test

| | Example 1 | Example 2 | Example 3 | Example 4 | Comparative Example |
|---|---|---|---|---|---|
| Judgment | Good | Good | Good | Good | Poor |
| Remarks | | | | | Carrier was dropped off |

The above results show that the holding materials of Examples 1 to 4 according to the invention can hold the catalyst carrier by uniform force from all circumferential directions.

The invention was detailed with reference specified embodiments. However, it is obvious to a person skilled in the art that the invention may be variously modified and corrected without deviating from the spirit of the invention.

This application is based on Japanese Patent Application No. 2008-314579 filed on Dec. 10, 2008 and an entirety thereof is incorporated herein by reference.

Furthermore, all references cited here are incorporated by reference.

What is claimed is:

1. A holding material for a catalytic converter comprising a catalyst carrier having an elliptical cross section, a metal casing for receiving the catalyst carrier, and the holding material mounted on the catalyst carrier and interposed in a gap between the catalyst carrier and the metal casing, wherein the holding material has a first portion and a second portion, and the first portion in contact with a region of the catalyst carrier, corresponding to 40 to 95% of a major axis centering on an intersection of an ellipse and a minor axis in the elliptical cross section of the catalyst carrier, is larger than the second portion in contact with any other region of the catalyst carrier in basis weight, wherein the holding material has a constant thickness and the fluctuation in thickness is ±10% or less, and the basis weight ratio of the first portion is from 1.05 to 2.0 times the basis weight of the second portion.

2. A catalytic converter comprising a catalyst carrier having mounted thereon the holding material for a catalytic converter according to claim 1 and incorporated in a metal casing, wherein the first portion of the catalytic converter has a density of 0.15 to 0.7 g/cm$^3$.

3. The holding material for a catalytic converter according to claim 1, wherein the basis weight of the first portion is 1.1 to 1.8 times the basis weight of the second portion.

4. The holding material for a catalytic converter according to claim 3, wherein the gap is from 2 mm to 6 mm and the basis weight of the first portion is from 900 g/m$^2$ to 1,800 g/m$^2$.

5. The holding material for a catalytic converter according to claim 3, wherein the gap is from 6 mm to 10 mm and the basis weight of the first portion is from 1,800 g/m$^2$ to 3,600 g/m$^2$.

6. The holding material for a catalytic converter according to claim 3, wherein the gap is from 8 mm to 12 mm and the basis weight of the first portion is from 2,200 g/m$^2$ to 4,500 g/m$^2$.

7. The holding material for a catalytic converter according to claim 1, wherein the basis weight of the first portion is 1.1 to 1.6 times the basis weight of the second portion.

8. The holding material for a catalytic converter according to claim 1, wherein the gap in the major axis direction is 1.5 times or less the gap in the minor axis direction.

9. The holding material for a catalytic converter according to claim 1, further comprising a low-friction sheet laminated on an outer circumferential surface of the second portion.

10. The holding material for a catalytic converter according to claim 1, wherein both ends on the major axis side cross the major axis at right angles.

11. A holding material for a catalytic converter comprising a catalyst carrier having a track-shaped cross section, a metal casing for receiving the catalyst carrier, and the holding material mounted on the catalyst carrier and interposed in a gap between the catalyst carrier and the metal casing, wherein the holding material has a first portion and a second portion, and the first portion in contact with a flat portion of the catalyst carrier is larger than the second portion in contact with a curved portion of the catalyst carrier in basis weight, wherein the holding material has a constant thickness and the fluctuation in thickness is ±10% or less, and the basis weight ratio of the first portion is from 1.05 to 2.0 times the basis weight of the second portion.

12. The holding material for a catalytic converter according to claim 11, wherein the first portion extends out to a part of the second portions.

13. A catalytic converter comprising a catalyst carrier having mounted thereon the holding material for a catalytic converter according to claim 11 and incorporated in a metal casing, wherein the first portion of the catalytic converter has a density of 0.15 to 0.7 g/cm$^3$.

14. The holding material for a catalytic converter according to claim 11, wherein the first portion is in contact with 5% to 35% of curved portions at opposite ends of the track-shaped cross section.

15. The holding material for a catalytic converter according to claim 11, further comprising a low-friction sheet laminated on an outer circumferential surface of the second portion.

* * * * *